US006862746B2

(12) United States Patent
Cym et al.

(10) Patent No.: US 6,862,746 B2
(45) Date of Patent: Mar. 8, 2005

(54) UNDERPANTS FOR MEN

(76) Inventors: Yong Cym, Shinwon Villa 501, 590, Guui 3-Dong, Gwangjin-Gu, Seoul 143-831 (KR); Eun-Su Shim, Shinwon Villa 501, 590, Guui 3-Dong, Gwangjin-Gu, Seoul 143-831 (KR); Eun-Ji Shim, Shinwon Villa 501, 590, Guui 3-Dong, Gwangjin-Gu, Seoul 143-831 (KR)

( * ) Notice: Subject to any disclaimer, the term of this patent is extended or adjusted under 35 U.S.C. 154(b) by 336 days.

(21) Appl. No.: 10/111,328

(22) PCT Filed: Aug. 23, 2001

(86) PCT No.: PCT/KR01/01426

§ 371 (c)(1),
(2), (4) Date: Aug. 8, 2002

(87) PCT Pub. No.: WO02/15726

PCT Pub. Date: Feb. 28, 2002

(65) Prior Publication Data

US 2004/0231034 A1 Nov. 25, 2004

(30) Foreign Application Priority Data

Aug. 23, 2000 (KR) ..... 2000-023890
Aug. 11, 2001 (KR) ..... 2001-024448 U

(51) Int. Cl.[7] ..... A41B 9/02
(52) U.S. Cl. ..... 2/403; 602/72
(58) Field of Search ..... 2/400, 403, 227, 2/405, 228, 238, 69, 79, 82; 602/67–72

(56) References Cited

U.S. PATENT DOCUMENTS

| | | | | | |
|---|---|---|---|---|---|
| 642,920 | A | * | 2/1900 | Potts | 602/69 |
| 2,139,532 | A | * | 12/1938 | Westerman | 602/67 |
| 4,526,167 | A | * | 7/1985 | Ebenal et al. | 602/70 |

FOREIGN PATENT DOCUMENTS

| | | |
|---|---|---|
| GB | 459968 | 1/1937 |
| JP | 53-44513 | 4/1978 |
| KR | 1993-0011918 | 7/1993 |
| KR | 0111067 | 10/1997 |
| KR | 1998-063520 | 11/1998 |
| KR | 20-0140036 | 12/1998 |

* cited by examiner

*Primary Examiner*—Gloria M. Hale
(74) *Attorney, Agent, or Firm*—Dickstein, Shapiro, Morin & Oshinsky, LLP.

(57) ABSTRACT

Disclosed are men's underpants enabling the penis and scrotum to protrude out of the underpants naturally as well as to be received in separate tubes so as to improve a user's sense of wearing. The underpants includes an underpants body having penis and scrotum outlet ports so as to pull out a user's penis and scrotum respectively, a penis receiving part having a tube shape of which both ends are open so that one end of the penis receiving part is coupled with the penis outlet port wherein the penis protrudes out of the underpants body through the penis outlet port so as to be received in the penis receiving part, and a scrotum receiving part of which one end is coupled with the scrotum outlet port so that the scrotum protruding out of the underpants body through the scrotum outlet port is received in the scrotum receiving part.

10 Claims, 6 Drawing Sheets

UNDERPANTS FOR MEN

TECHNICAL FIELD

The present invention relates to men's underpants, and more particularly, to men's underpants which permit the penis and scrotum to protrude out of the underpants naturally as well as to be received in separate tubes so as to improve a user's sense of wearing.

BACKGROUND ART

Generally, men's underpants are mainly divided into "triangular underpants" and "rectangular underpants" in accordance with their general frontal appearance and are made of cotton fabrics so as to absorb sweat and the like. A port is formed at a front of the men's underpants to permit pulling the penis out of the underpants for urination.

Lately, as a style of dressing is considered important, the men's underpants have a tendency to be tight to a human body when being worn. When a user wears such men's underpants, the penis and scrotum are caused to adhere closely to each other by the elasticity of the underpants body so as to increase the temperature at the scrotum. Therefore, generation and cultivation of spermatozoa in testicles and epididymides are damaged as well as bringing about a wet crotch and/or eczema and the like.

Men's underpants considering such problems are disclosed in Korean Utility Public Laid-Open No. 96-28069 (hereinafter called 'first prior art') of "Healthy Underpants" and Korean Utility Public Laid-Open No. 2000-3257 (hereinafter called 'second prior art') of "Healthy Underpants Having a Scrotum Receiving Tube".

FIG. 1 illustrates a perspective view of men's healthy underpants according to the first prior art.

Referring to FIG. 1, a men's underpants 110 according to the first prior art include an underpants body 111, a separation body 121 arranged at a front inside of the underpants body 111 having a penis outlet port 131 and a scrotum outlet port 125, respectively, a penis receiving part 127 of which one end is fixed to the penis outlet port 131 and the other end extends in a length direction of the penis so as to receive the penis inside, and a scrotum receiving part 129 formed below the penis outlet port 125 so as to be contacted with the scrotum by sewing to attach hemp cloth thereto.

And, a scrotum supporting part 133 is formed at a circumference of the scrotum outlet port 125.

The men's underpants 110 according to the first prior art provide the separation body 121, penis receiving part 127, and scrotum receiving part 129. Yet, the separation body 121, penis receiving part 127, and scrotum receiving part 129 are placed inside the underpants body 111 so as to press the penis and scrotum with the elastic force of the underpants body 111 to adhere closely to a human body. Therefore, reciprocal adhesion occurs with ease, thereby increasing the temperature of the scrotum. Thus, it is unlikely to expect sufficient advantages.

Moreover, a band around the penis outlet port 131 to make the penis protrude and the scrotum supporting part 133 at the circumference of the scrotum outlet port 125 are formed of a material having a relatively strong elastic force such as a rubber band or the like, thereby causing an unpleasant sense of wearing as well as damages on skins of the penis and scrotum.

FIG. 2 illustrates a bird's-eye view of men's underpants according to the second prior art, and FIG. 3 illustrates a vertical cross-sectional view of the men's underpants according to the second prior art in FIG. 2.

Referring to FIG. 2 and FIG. 3, the men's underpants according to the second prior art includes a scrotum housing 143 protruding out to a predetermined height so as to receive the scrotum. Yet, the inside of the scrotum housing 143 corresponding to a shape of the scrotum is formed to be concave. Therefore, the scrotum housing 143 fails to receive both of the penis and scrotum inside.

When the penis and scrotum are received simultaneously, the second prior art causes more unpleasantness due to the pressure on the penis and scrotum than general men's underpants does. Besides, the temperature increase of the scrotum greatly reduces the capability of generation and cultivation of spermatozoa, thereby failing to provide advantages sufficiently.

DISCLOSURE OF THE INVENTION

Accordingly, the present invention is directed to men's underpants that substantially obviate one or more of the problems due to limitations and disadvantages of the related art.

An object of the present invention is to provide men's underpants constructed in a manner that the penis and scrotum protruding out of an underpants body are received separately so as to interrupt the temperature increase due to reciprocal contacts between the penis and scrotum and the like.

Another object of the present invention is to provide men's underpants constructed in a manner that opening/closing of a penis receiving part is carried out with ease so as to improve the user's convenience for urination and the like.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, men's underpants include an underpants body having penis and scrotum outlet ports so as to pull out a user's penis and scrotum respectively, a penis receiving part having a tube shape of which both ends are open so that one end of the penis receiving part is coupled with the penis outlet port wherein the penis protrudes out of the underpants body through the penis outlet port so as to be received in the penis receiving part, and a scrotum receiving part of which one end is coupled with the scrotum outlet port so that the scrotum protruding out of the underpants body through the scrotum outlet port is received in the scrotum receiving part.

Preferably, a portion of the penis receiving part is incised along a length direction and a coupling means is installed at the incised portion so that the penis received in the penis receiving part is exposed externally.

Preferably, the incised portion of the penis receiving part is arranged so as be overlapped with each other and the coupling means is installed at the overlapped portions.

Preferably, a tip of the scrotum receiving part is open.

Preferably, the scrotum receiving part further comprises a closing/opening means for closing/opening the tip of the scrotum receiving part.

Preferably, a fixing means for fixing the scrotum receiving part to the underpants body is installed between the underpants body and scrotum receiving part so as to make the scrotum receiving part adhere closely to the underpants body.

Preferably, a fixing means for fixing the scrotum receiving part to the underpants body is installed between the underpants body and scrotum receiving part so as to make the scrotum receiving part adhere closely to the underpants body.

Preferably, the penis receiving part includes an outer cover material having an incised portion incised in a protruding direction of the penis wherein one end of the outer cover material is coupled with the penis outlet port and the other end of the outer cover material is extended so as to surround the penis, a zipper coupled with both sides of the incised portion respectively so as to open/close the incised portion, and a coupling material arranged inside the zipper so that the zipper is not contacted with the penis, the coupling material expanding when the zipper is opened.

Preferably, the coupling material is inserted between the outer cover material and a strip of the zipper and sewed in one body with the outer cover material and the strip of the zipper.

Preferably, at least one of the outer cover material and the coupling material includes hemp cloth and cotton fabrics at least in part.

Preferably, the coupling material has a non-coupled section separated from the outer cover material.

The present invention is characterized in that the penis and scrotum protruding out of an underpants body are received separately through penis and scrotum receiving tubes so as to improve a user's sense of wearing as well as to control the temperature by a self-expansion/contraction of the scrotum to maintain a healthy environments.

Moreover, the present invention is characterized in that a zipper is installed at a penis receiving tube in a length direction to open in accordance with the user's necessity so as to pull out the penis conveniently for urination and the like.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
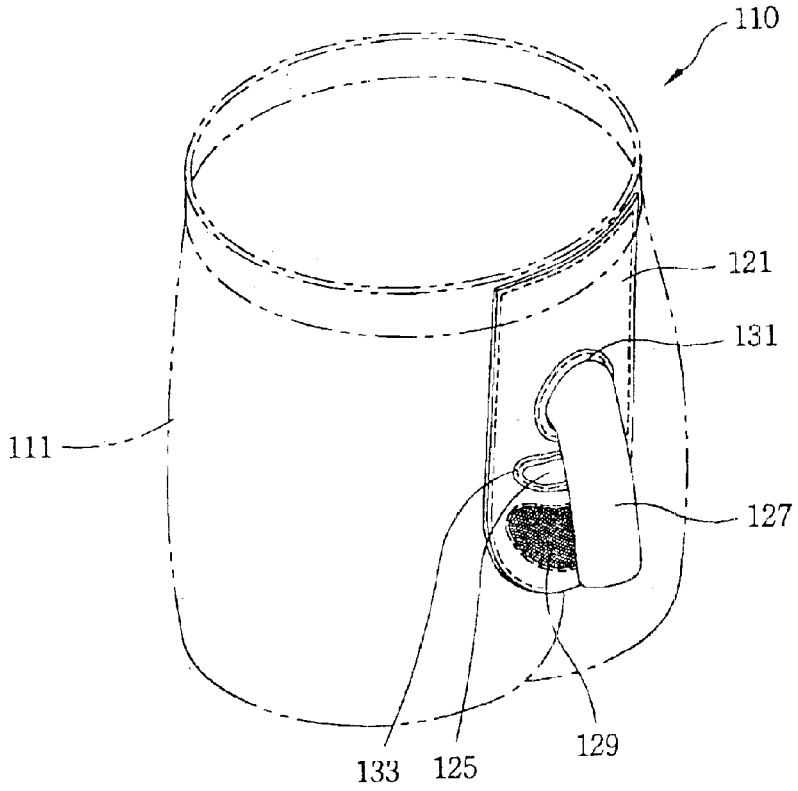
FIG. 1 illustrates a perspective view of men's underpants according to the first prior art.
Figure 2:
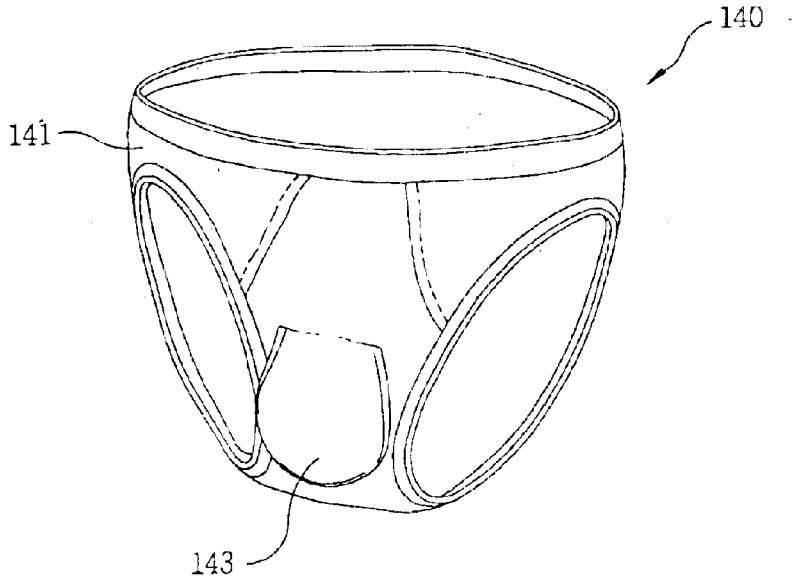
FIG. 2 illustrates a bird's-eye view of men's underpants according to the second prior art.
Figure 3:
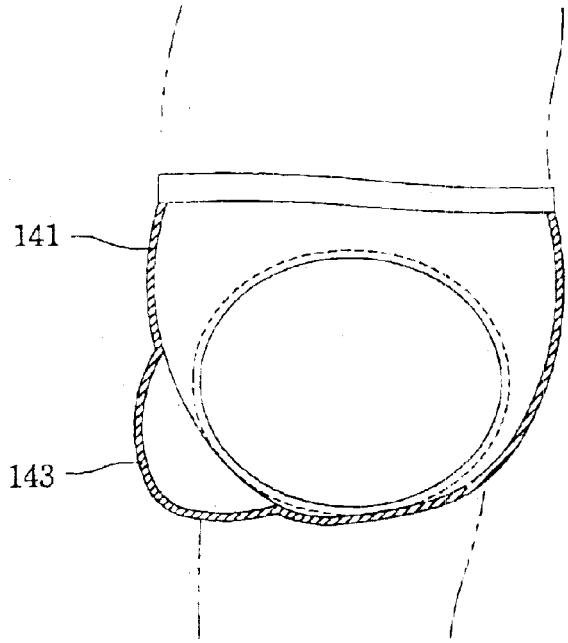
FIG. 3 illustrates a vertical cross-sectional view of the men's underpants according to the second prior art in FIG. 2.
Figure 4:
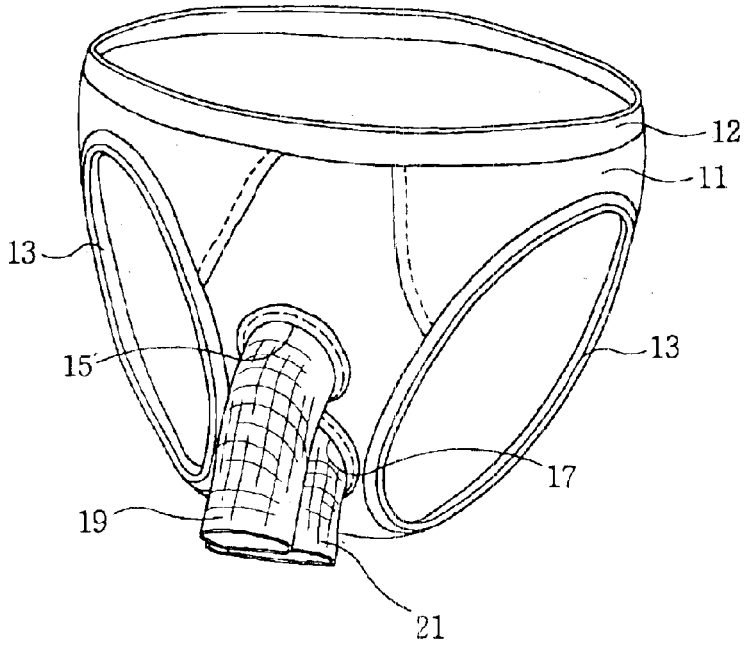
FIG. 4 illustrates a bird's-eye view of men's underpants according to a first embodiment of the present invention.
Figure 5:
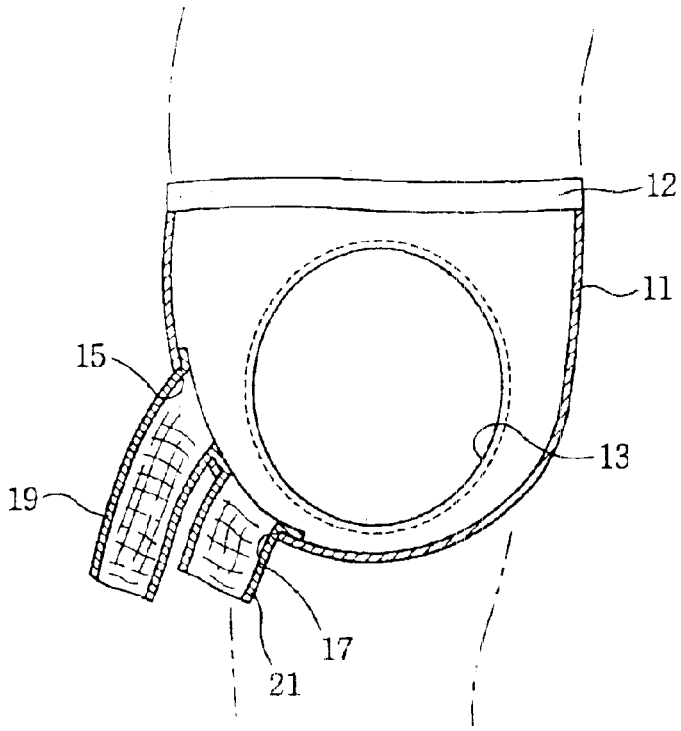
FIG. 5 illustrates a vertical cross-sectional view of the men's underpants in FIG. 4.

FIG. 4 illustrates a bird's-eye view of men's underpants according to a first embodiment of the present invention, and FIG. 5 illustrates a vertical cross-sectional view of the men's underpants in FIG. 4.

Referring to FIG. 4 and FIG. 5, men's underpants according to a first embodiment of the present invention includes an underpants body 11 having a penis outlet port 15 and a scrotum outlet port 17 formed respectively at a front of the underpants body 11, a penis receiving part 19 having a tube-like shape of which both ends are open and of which one end is coupled with the penis outlet port 15 so as to receive the penis inside, and a scrotum receiving part 21 having a tube-like shape of which both ends are open and of which one end is coupled with the scrotum outlet port 17 so as to receive the scrotum inside.

A band part 12 is formed at an upper end of the underpants body 11, and a pair of leg outlet ports 13 are respectively formed at a lower end of the underpants body 11 so as to let legs pass through.

Considering the poromeric property and contact with the penis, the penis receiving part 19 is preferably formed of a coarse material such as hemp cloth and the like. And, the scrotum receiving part 21 is formed tube-like using hemp cloth or cotton fabrics.

A method of wearing the above-constructed men's healthy underpants is explained in the following description.

First, the band part 12 of the underpants body 11 is pulled upward while both legs of a user are inserted in the leg outlet ports 13.

Then, the user's penis protrudes out of the underpants body 11 naturally through the penis outlet port 15 so as to be received in the penis receiving part 19. Besides, the scrotum is received to protrude out of the underpants body 11 through the scrotum outlet port 17 as well.

In this case, the protruding penis and scrotum are received in the penis and scrotum receiving parts 19 and 21, respectively, even though the underpants body 11 adheres closely to a user's body by the elastic force on the body itself. Thus, the penis and scrotum are free from being pressed by the elastic force of the underpants body 11.

Namely, the penis protrudes out of the underpants 11 through the penis outlet port 15 so as to maintain its natural state, and the scrotum received in the scrotum receiving part 21 is suspended by gravity so as to expand and contract to control the surrounding temperature properly. Therefore, it is always possible to maintain healthy environments.

Figure 6:
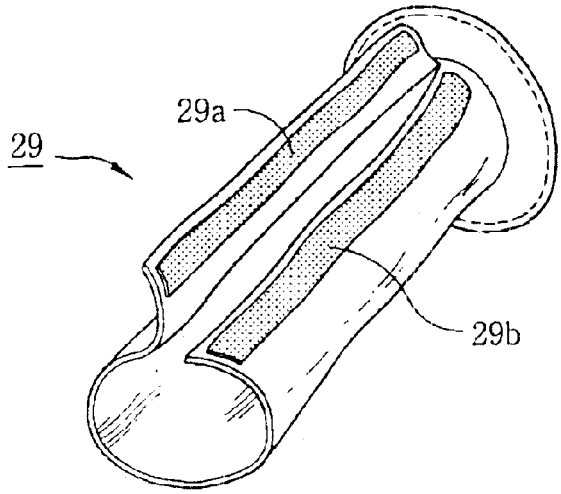
FIG. 6 illustrates a bird's-eye view of a penis receiving tube in men's underpants according to a second embodiment of the present invention.

FIG. 6 illustrates a bird's-eye view of a penis receiving tube in a men's underpants according to a second embodiment of the present invention.

For explaining the second embodiment of the present invention, some parts similar or equal to the first embodiment are described by referring to FIG. 4 and FIG. 5.

Referring to FIG. 6, the men's underpants according to a second embodiment of the present invention includes an underpants body 11 having a penis outlet port 15 and a scrotum outlet port 17 formed respectively at a front of the underpants body 11, a penis receiving part 29 having a tube-like shape of which both ends are open and of which one end is coupled with the penis outlet port 15 so as to make the penis pass through, and a scrotum receiving part 21 of which one end is coupled with the scrotum outlet port 17 so as to receive the scrotum inside.

Specifically, one end of the penis receiving part 29 is coupled with and fixed to a circumference of the penis outlet port 15. And, the penis receiving part 29 is incised in a length direction and both edges of the incised part are extended so as to be overlapped with each other to a predetermined extent in a circumferential direction.

And, adhesive materials 29*a* and 29*b*, which are detachable and can be Velcro hook and boo fasterner or magic tapes, of fibrous materials are attached to both reciprocal contact areas of the overlapped edges of the incised part.

When the penis protruding out of the underpants body 11 through the penis outlet port 15 is to be exposed externally, the men's underpants according to the second embodiment of the present invention enables one to pull out he penis conveniently by pulling the edge of the overlapped areas of the penis receiving part 29 so as to detach the adhesive materials each other.

Figure 7:
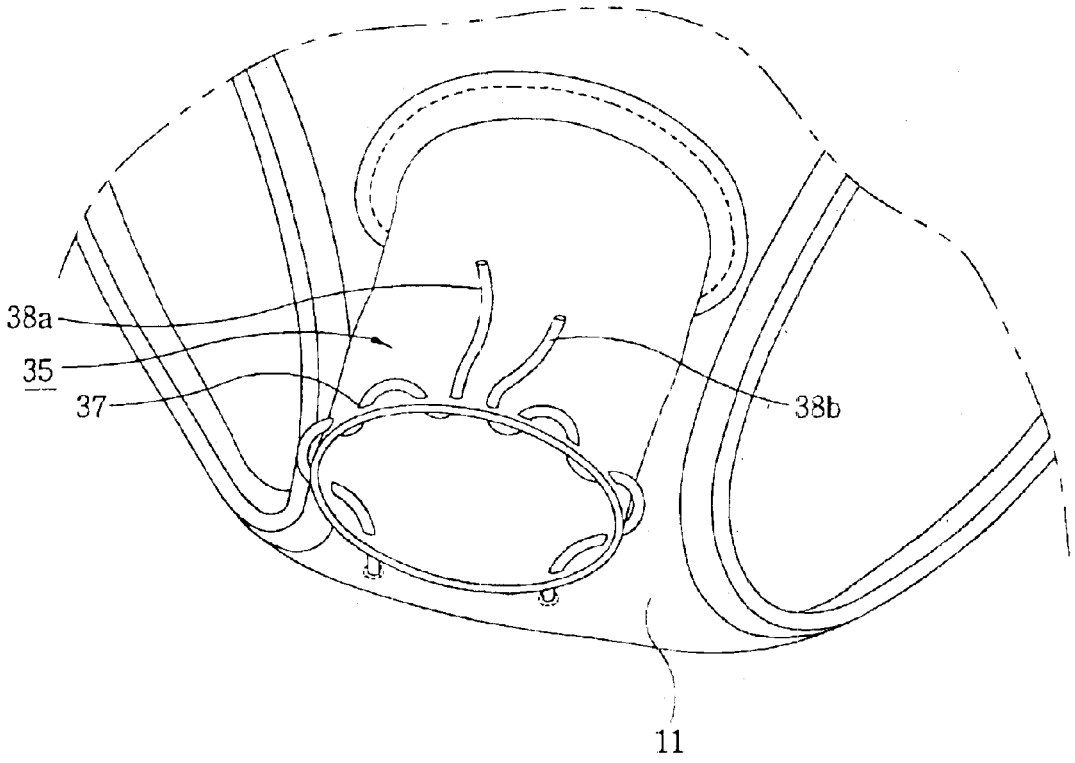
FIG. 7 illustrates a bird's-eye view of a penis receiving tube in men's underpants according to a third embodiment of the present invention.

FIG. 7 illustrates a bird's-eye view of a penis receiving tube in a men's underpants according to a third embodiment of the present invention.

For explaining a third embodiment of the present invention, some parts similar or equal to the first embodiment are described by referring to FIG. 4 and FIG. 5.

Referring to FIG. 7, a men's underpants according to a third embodiment of the present invention, similar to those of the second embodiment, includes an underpants body 11 having a penis outlet port 15 and a scrotum outlet port 17 formed respectively at a front of the underpants body 11, a penis receiving part 19 having a tube-like shape of which both ends are open and of which one end is coupled with the penis outlet port 15, and a scrotum receiving part 35 of which one end is coupled with/fixed to the scrotum outlet port 17 so as to receive the scrotum inside.

Specifically, a pair of fixing bands 38*a* and 38*b* are formed at the other end of the scrotum receiving part 35 so as to fix the scrotum receiving part 35 to the underpants body 11.

Namely, a plurality of band-through holes 37 are formed at the other end of the scrotum receiving part 35 so as to permit the fixing bands 38*a* and 38*b* to pass therethrough.

While one ends of each of the fixing bands 38*a* and 38*b* are fixed to the underpants body 11 respectively, the other ends of the fixing bands 38*a* and 38*b* pass through the respective band-through holes 37 in zigzag fashion so that portions of the other ends of the fixing bands 38*a* and 38*b* protrude out of the scrotum receiving part 35.

In the men's underpants according to the third embodiment of the present invention, when the scrotum receiving part 35 is to be fixed to the underpants body 11, the respective fixing bands 38*a* and 38*b* are pulled for fastening in cross directions so that the other end of the scrotum receiving part 35 becomes closely tightened to the underpants body 11.

In this case, the opening/closing degree of the scrotum receiving part 35 is adjusted by the degree of fastening the fixing bands 38*a* and 38*b*.

In the third embodiment of the present invention, a pair of the fixing bands shut the scrotum receiving part as well as fix the scrotum receiving part to the underpants body. Yet, the third embodiment according to the present invention may further include a closing/opening means (e.g., Velcro hook and loop fastener or magic tapes, snap buttons and the like) enabling to one to open/shut the other end of the scrotum receiving part. Furthermore, the third embodiment according to the present invention may further include a fixing means (e.g., Velcro or magic tapes, snap buttons and the like) contact areas between the scrotum receiving part and underpants body so as to open/shut the other end of the scrotum receiving part.

Moreover, in the third embodiment of the present invention, the fixing bands pass zigzag through the band-through holes formed at the other end of the scrotum receiving part. Instead, the third embodiment of the present invention may include a fixing band receiving part at the other end of the scrotum receiving part so that the fixing bands are received in part along a circumferential direction and that free-end parts of the fixing bands extend to be exposed.

The first to third embodiments of the present invention describe cases in which the penis and scrotum receiving parts are coupled with/fixed to the underpants bodies. Instead, the penis and scrotum receiving parts may be formed detachable from the underpants bodies as well.

The second and third embodiments of the present invention shown in FIG. 6 and FIG. 7 describes cases where the penis receiving part (in FIG. 6) and the scrotum receiving part (in FIG. 7) are applied to the first embodiment, respectively, in connection with FIG. 4 and FIG. 5. Instead, the penis and scrotum receiving parts of FIG. 6 and FIG. 7 may be applied to the men's healthy underpants in FIG. 4 and FIG. 5.

Figure 8:
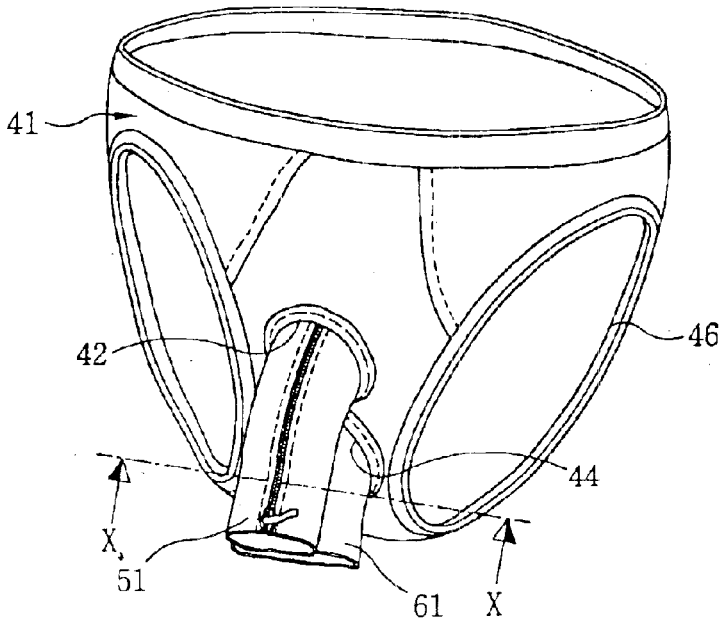
FIG. 8 illustrates a bird's-eye view of men's underpants according to a fourth embodiment of the present invention.
Figure 9:
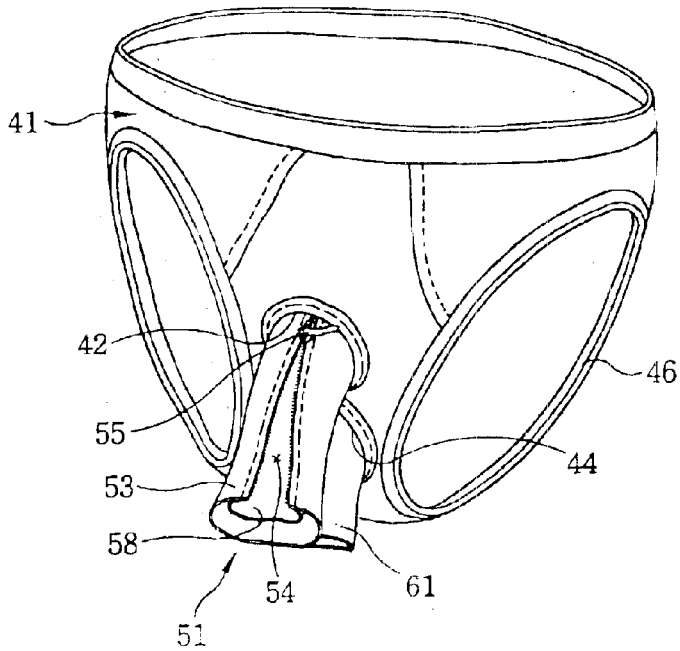
FIG. 9 illustrates a bird's-eye view of a zipper-opened state of the men's underpants in FIG. 8.
Figure 10:
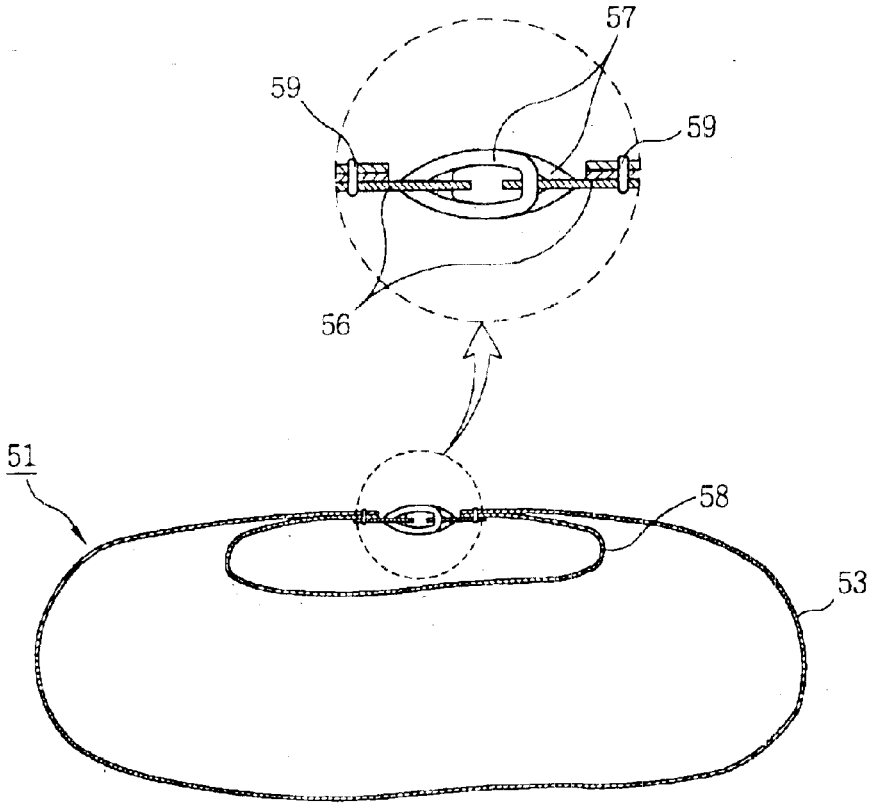
FIG. 10 illustrates a magnified cross-sectional view of the men's underpants bisected along a line X—X in FIG. 8.

FIG. 8 illustrates a bird's-eye view of men's underpants according to a fourth embodiment of the present invention, FIG. 9 illustrates a bird's-eye view of a zipper-opened state of the men's underpants in FIG. 8, and FIG. 10 illustrates a magnified cross-sectional view of the men's underpants bisected along a line X—X in FIG. 8.

Referring to FIG. 8 to FIG. 10, the men's underpants according to a fourth embodiment of the present invention includes an underpants body 41 having a penis outlet port 42 permitting a penis to protrude out naturally and a penis receiving part 51 of which one end is coupled with the penis outlet port 42 and of which other end extends along a protruding direction of the penis so as to receive the penis protruding out of the underpants body 41.

The underpants body 41 has a triangular shape having a pair of leg-outlet ports 46 at both bottoms, whereby the user's legs can penetrate into the leg-outlet ports 46 respectively. And, a scrotum outlet port 44 is formed at the underpants body 41 below the penis outlet port 42. A bag-like scrotum receiving part 61 is coupled with the scrotum outlet port 44 50 that the scrotum extending out of the underpants body 41 is naturally received therein.

Specifically, the penis receiving part 51 includes an outer cover material 53 having an incised part 54 bisected along a protruding direction of the penis and of which one end is coupled with the penis outlet port 42, a zipper 55 coupled with along both edges of the incised part 54 of the outer cover material 53 so as to open/close the incised part 54, and a coupling material 58 arranged between the zipper 55 and penis so as to prevent the zipper 55 and penis from being in contact with each other and of which both ends are coupled with the incised part 54 of the outer cover material 53.

In this case, the outer cover material 53 is unfolded to have a rectangular shape. An inside diameter sufficient to receive the penis inside is provided by the outer cover material 53. The incised part 54 is formed at a top of the outer cover material 53 in a length direction. And, a strip 56 of the zipper 55 is coupled with both sides of the incised part 54.

The coupling material 58 has a triangular shape extending gradually from an upper part of the penis receiving part 51 to a lower part of the penis receiving part 51. Therefore, when the zipper 55 becomes opened, the lower part of the penis receiving part 51 gets wider than the upper part toward the penis outlet port 42.

In this case, a numeral '57' indicates teeth of the zipper 55 and a numeral '59' indicates a sewed thread.

Besides, the outer cover material 53 and coupling material 58 may be formed of one of cotton fabrics and hemp cloth. Instead, the outer cover material 53 and coupling material 58 are formed of cotton fabrics and a contact plate (not shown in the drawing) of hemp cloth is further attached to a predetermined place inside so as to be contacted and/or rubbed with the penis to strengthen the function thereof.

In the above-constructed men's underpants according to the fourth embodiment of the present invention, if the underpants body 41 is pulled upward while the legs are put in the underpants body 41 through the leg-outlet ports 46, the penis and scrotum comes to protrude out of the underpants body 41 through the penis and scrotum outlet ports 42 and 44 so as to be naturally received in the penis and scrotum receiving parts 51 and 61, respectively.

When a user draws a handle of the zipper 54 toward the penis outlet port 42 to open the incised part 54 of the outer cover material 53, a tip of the outer cover material 53 gets wider so as to expose the penis externally with ease.

Figure 11:
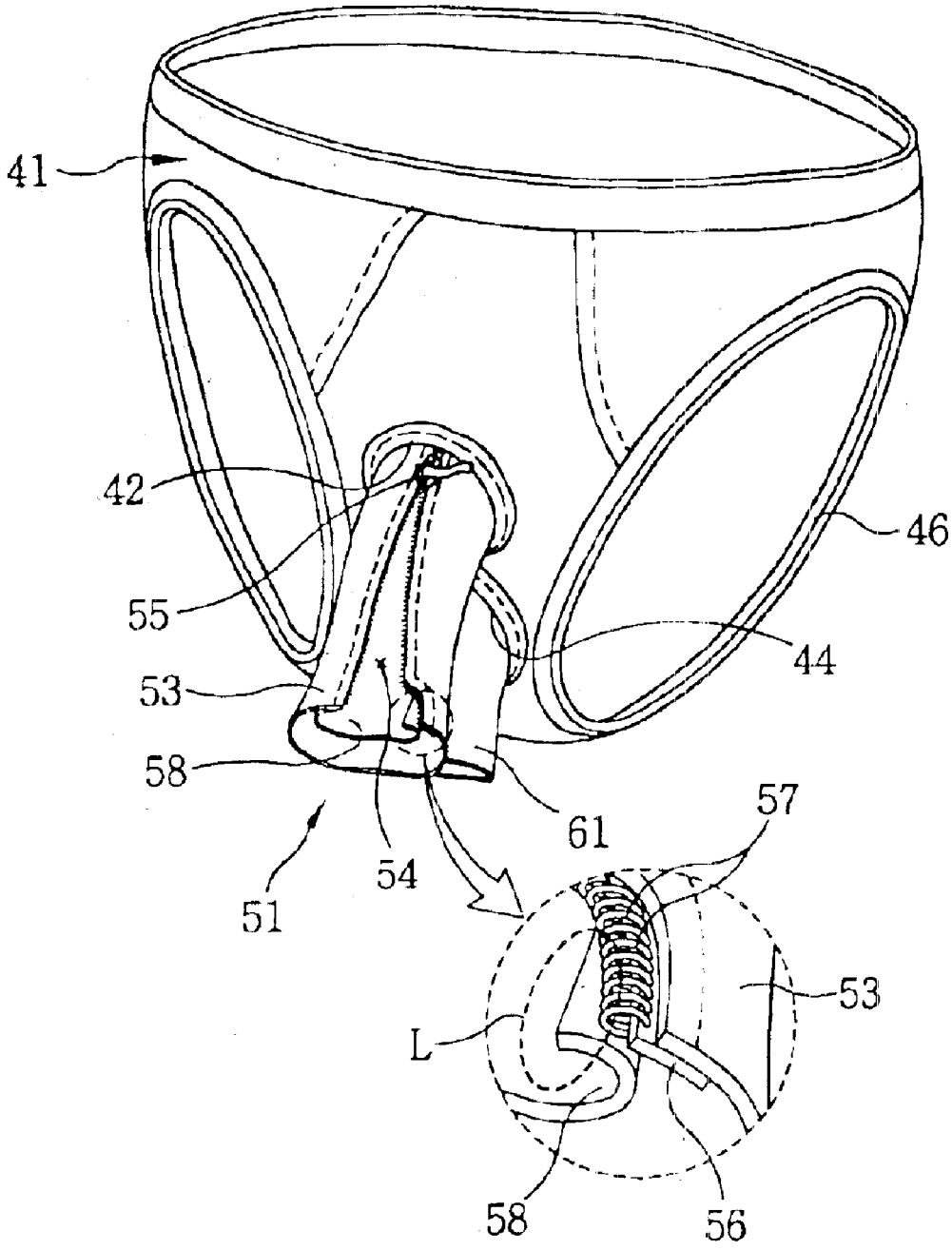
FIG. 11 illustrates a bird's-eye view of men's underpants and a magnified view of a major part according to a fifth embodiment of the present invention.

FIG. 11 illustrates a bird's-eye view of men's underpants and a magnified view of a major part according to a fifth embodiment of the present invention.

For explaining a fifth embodiment of the present invention, some parts similar or equal to the fourth embodiment are given with the same numerals and description thereof is skipped in the following.

Referring to FIG. 11, the men's underpants according to a fifth embodiment of the present invention includes an underpants body 41 and penis and scrotum receiving parts 51 and 61 coupled with the underpants body 41 respectively so as to receive penis and scrotum separately.

The penis receiving part 51 includes an outer cover material 53 having an incised part 54 bisected along a protruding direction of the penis and of which one end is coupled with the penis outlet port 42, a zipper 55 coupled with along both edges of the incised part 54 of the outer cover material 53 so as to open/close the incised part 54, and a coupling material 58 arranged between the zipper 55 and penis so as to prevent the zipper 55 and penis from being contacted with each other and of which sides are coupled with the incised part 54 of the outer cover material 53.

Specifically, one side of the coupling material 58 is entirely coupled with the outer cover material 53 along the incised part 54 by sewing. But, the other side of the coupling material 58 is inserted in part between the outer cover material 53 and the strip 56 of the zipper 55 so as to be sewn in one body to the extent of a predetermined length from the underpants body 41. And, the remaining portion of the other side of the coupling material 58 is free from sewing so as to provide an uncoupled section L separated from the outer cover material 53 and the strip 56 of the zipper 56 in order to pull out the penis with ease for urination.

The fourth and fifth embodiments of the present invention describe the cases that the incised part is formed along an entire length section of the penis receiving part. Instead, the fourth and fifth embodiments of the present invention may form the incised part partially from a tip of the penis receiving part to a predetermined length only in a length direction of the penis receiving part.

Moreover, the fourth and fifth embodiments of the present invention describe cases where the incised part is formed at a top of the penis receiving part. Instead, the incised part may be formed over a left or right side of the penis receiving part in accordance with usage and design conditions.

The above-constructed and above-operating men's underpants according to the present invention, in which the penis and scrotum outlet ports are formed respectively so as to permit the penis and scrotum protrude out without being pressed by the underpants body and the penis and scrotum are received separately in the penis and scrotum receiving parts provided at the penis and scrotum outlet ports, thereby enabling an improvement of a user's sense of wearing as well as control of the temperature by a self-expansion/contraction of the scrotum to maintain healthy environment.

Moreover, the present invention permits an installed zipper at the penis receiving part in a length direction to open in accordance with the user's necessity so as to pull out the penis conveniently for urination and the like.

While the present invention has been described and illustrated herein with reference to the preferred embodiments thereof, it will be apparent to those skilled in the art that various modifications and variations can be made therein without departing from the spirit and scope of the invention. Thus, it is intended that the present invention cover the modifications and variations of this invention that come within the scope of the appended claims and their equivalents.

What is claimed is:

1. Men's underpants comprising:

an underpants body having penis and scrotum outlet ports so as to pull out a user's penis and scrotum respectively;

a penis receiving part having a tube shape of which both ends are open so that one end of the penis receiving part is coupled with the penis outlet port wherein the penis protrudes out of the underpants body through the penis outlet port so as to be received in the penis receiving part; and a scrotum receiving part of which one end is coupled with the scrotum outlet port so that the scrotum protruding out of the underpants body through the scrotum outlet port is received in the scrotum receiving part and a second end of the scrotum receiving part is open.

2. Men's underpants comprising:

an underpants body having penis and scrotum outlet ports so as to pull out user's penis and scrotum respectively;

a penis receiving part having a tube shape of which both ends are open so that one end of the penis receiving part is coupled with the penis outlet port wherein the penis protrudes out of the underpants body through the penis outlet port so as to be received in the penis receiving part; and a scrotum receiving part of which one end is coupled with the scrotum outlet port so that the scrotum protruding out of the underpants body through the scrotum outlet port is received in the scrotum receiving part, wherein a portion of the penis receiving part is incised along a length direction and a coupling means is installed at the incised portion so that the penis received in the penis receiving part is exposed externally.

3. The men's underpants of claim 2, wherein the incised portion of the penis receiving part is arranged so as be overlapped with each other and the coupling means is installed at the overlapped portions.

4. The men's underpants of claim 1, wherein the scrotum receiving part further comprises a closing/opening means for closing/opening the tip of the scrotum receiving part.

5. The men's underpants of claim 1, wherein a fixing means for fixing the scrotum receiving part to the underpants body is installed between the underpants body and scrotum receiving part so as to make the scrotum receiving part adhere closely to the underpants body.

6. The men's underpants of claim 1, wherein a fixing means for fixing the scrotum receiving part to the underpants body is installed between the underpants body and scrotum receiving part so as to make the scrotum receiving part adhere closely to the underpants body.

7. Men's underpants comprising:

an underpants body having penis and scrotum outlet ports so as to pull out user's penis and scrotum respectively;

a penis receiving part having a tube shape of which both ends are open so that one end of the penis receiving part is coupled with the penis outlet port wherein the penis protrudes out of the underpants body through the penis outlet port so as to be received in the penis receiving part; and a scrotum receiving part of which one end is coupled with the scrotum outlet port so that the scrotum protruding out of the underpants body through the scrotum outlet port is received in the scrotum receiving part, wherein the penis receiving part comprises:

an outer cover material having an incised portion incised in a protruding direction of the penis wherein one end of the outer cover material is coupled with the penis outlet port and the other end of the outer cover material is extended so as to surround the penis;

a zipper coupled with both sides of the incised portion respectively so as to open/close the incised portion; and a coupling material arranged inside the zipper so that the zipper is not contacted with the penis, the coupling material expanding when the zipper is opened.

8. The men's underpants of claim 7, wherein the coupling material is inserted between the outer cover material and a strip of the zipper and sewed in one body with the outer cover material and the strip of the zipper.

9. The men's underpants of claim 7, wherein at least one of the outer cover material and the coupling material includes hemp cloth and cotton fabrics in part at least.

10. The men's underpants of claim 1, wherein the coupling material has a non-coupled section separated from the outer cover material.

* * * * *